United States Patent [19]

Butler

[11] Patent Number: 4,684,162

[45] Date of Patent: Aug. 4, 1987

[54] TILTING HOIST TACKLE

[75] Inventor: David L. Butler, Edmonds, Wash.

[73] Assignee: Oberg Enterprises, Inc., Everett, Wash.

[21] Appl. No.: 867,186

[22] PCT Filed: Dec. 13, 1985

[86] PCT No.: PCT/US85/02481

§ 371 Date: Apr. 25, 1986

§ 102(e) Date: Apr. 25, 1986

[87] PCT Pub. No.: WO87/03570
PCT Pub. Date: Jun. 18, 1987

[51] Int. Cl.[4] ..... B66C 1/12

[52] U.S. Cl. ..... 294/82.12

[58] Field of Search ..... 294/67.5, 74, 82.11–82.13, 294/86.41; 254/389–391, 403, 411

[56] References Cited

U.S. PATENT DOCUMENTS

| | | | |
|---|---|---|---|
| 2,356,147 | 8/1944 | Caldwell | 294/82.12 |
| 2,617,677 | 11/1952 | Pridy | 294/82.12 X |
| 2,620,218 | 12/1952 | Morith | 294/82.12 |
| 2,629,625 | 2/1953 | Phillips | 294/74 |
| 3,254,913 | 6/1966 | Young | 294/82.12 |
| 3,391,957 | 7/1968 | Ehrhardt | 294/82.12 |

FOREIGN PATENT DOCUMENTS

| | | | |
|---|---|---|---|
| 1576311 | 10/1980 | United Kingdom | 294/82.12 |
| 998288 | 2/1983 | U.S.S.R. | 294/82.12 |
| 1096187 | 6/1984 | U.S.S.R. | 294/82.12 |

*Primary Examiner*—Johnny D. Cherry
*Attorney, Agent, or Firm*—Ward Brown; Robert W. Beach

[57] ABSTRACT

Two separate sling lines have inner end portions secured to a drum mounted in a block and are wound in opposite senses around the drum. The block is adapted to be connected to a hoist and the free end portions of the sling lines are adapted to be connected to a load at spaced locations. During or after lifting the load by use of the hoist, the drum can be rotated to haul in one sling line while automatically paying out the other and thereby tilt the load.

8 Claims, 7 Drawing Figures

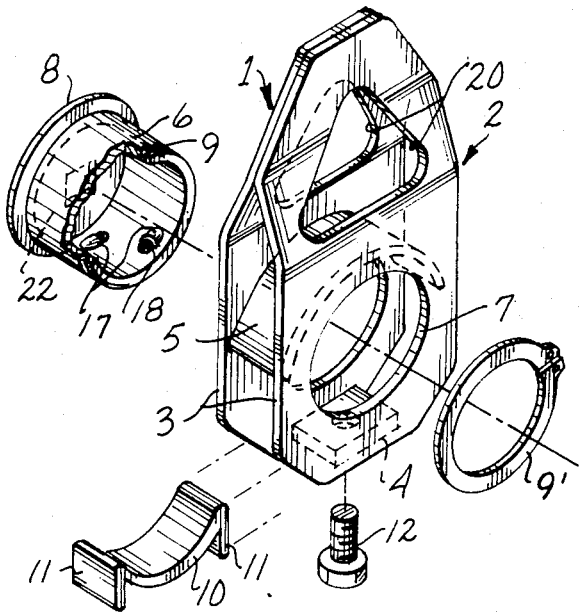
Fig. 1.
Fig. 2.
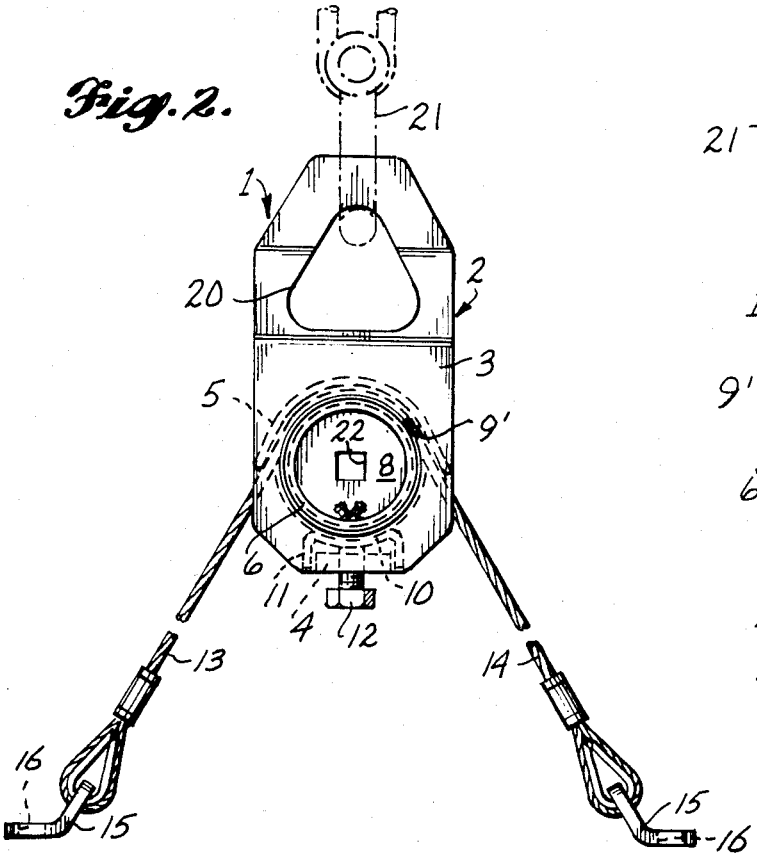
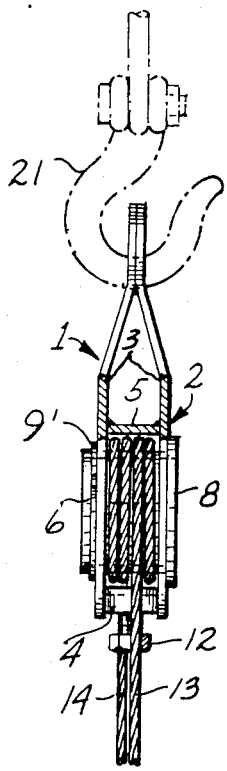
Fig. 3.

TILTING HOIST TACKLE

DESCRIPTION

1. Technical Field

This invention relates to tackle acting as an adjustable sling connected between a conventional hoist and a load to be lifted and allowing the load to be tilted and maintained in the tilted position.

2. Background Art

When lifting a load with a hoist and a sling, it is sometimes desirable or required to tilt the load, such as when removing or installing the engine of a vehicle, which can require changing the attachment of the hoist to the sling.

Ehrhardt U.S Pat. No. 3,391,957, issued July 9, 1968, discloses a "Universal Hoisting Fixture" in which the central portion of a single sling line is wound on a drum and the free ends of the line are connected to the load to be lifted. The drum can be turned for tilting the load. Prior to lifting the load the loose coils of sling line may become crossed or bind against each other on the frame supporting the drum making it difficult to rotate the drum. In addition, as the drum is rotated the coils of sling line have a tendency to progress toward a side of the frame and can exert substantial side pressure on the frame. Further, only the weight of the load tightening the coils on the drum deters the line from slipping relative to the drum, and in an extreme tilted position the load can slip toward a more horizontal position.

DISCLOSURE OF THE INVENTION

The tilting hoist tackle in accordance with the present invention includes a drum rotatably mounted in a block adapted to be connected to a conventional hoist and two separate sling lines each with one end portion secured to the drum. The sling lines are wound in opposite senses around the drum and their free end portions are adapted to be connected at spaced locations to the load to be lifted. Mechanism is provided for locking the drum relative to its block and, with the locking mechanism released, the drum can be rotated to haul in one sling line while paying out the other so as to tilt the load, whereupon the locking mechanism can be actuated to maintain the load in its tilted position. A guide plate is provided to prevent the coils of sling lines from crossing or riding up on each other. The tackle is of simple and inexpensive construction, in compact form and easy to use, yet rugged and reliable for repeated use over a long period.

BRIEF DESCRIPTION OF THE DRAWINGS

FIG. 1 is a top perspective of tilting hoist tackle in accordance with the present invention with some parts shown in exploded relationship and some parts deleted;

FIG. 2 is a somewhat diagrammatic side elevation of the tilting hoist tackle of FIG. 1 in assembled condition, and FIG. 3 is a somewhat diagrammatic end elevation thereof with parts broken away;

BEST MODE FOR CARRYING OUT THE INVENTION

Figure 4:
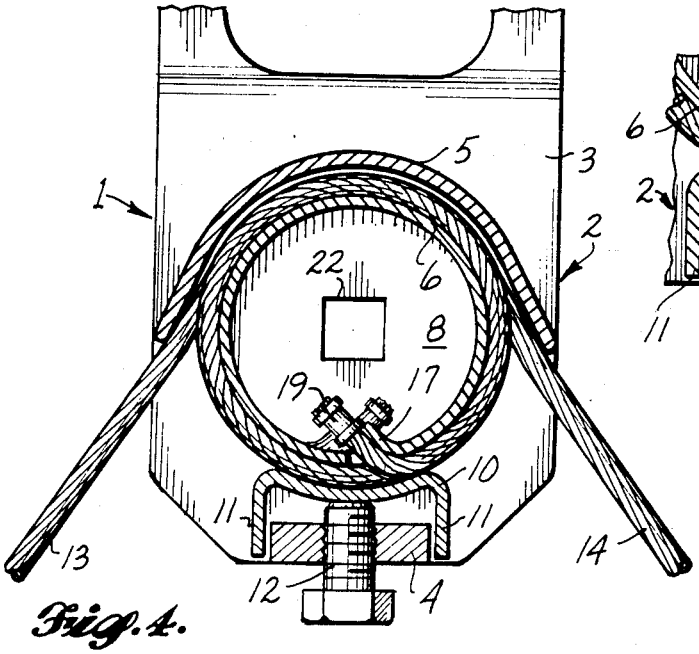
FIG. 4 is an enlarged, fragmentary, vertical, transverse section of the tilting hoist tackle of FIGS. 1, 2 and 3.

As shown in FIGS. 1, 2 and 3, the tilting hoist tackle 1 in accordance with the present invention includes a frame or block 2 having complementary upright cheeks 3. The lower portions of the cheeks are maintained in spaced parallel relationship by a horizontal bottom cross plate 4 and an arcuate top cross plate 5 welded to the facing surfaces of the cheeks. The upper end portions of the cheeks are bent inward and are spot-welded together.

The drum 6 of the tackle is journaled in registered holes 7 in the lower portions of the cheeks between the two cross plates 4 and 5. The drum has a circular end plate 8 of a diameter greater than the holes 7 to limit insertion of the drum in its block. At the opposite end portion of the drum from its end plate 8, the drum has an annular groove 9 for a snap ring 9' to prevent withdrawal of the drum from its block.

A U-shaped drum clamp 10 is fitted over the bottom cross plate 4 with its downward-projecting legs 11 preventing separation of the clamp from the tackle block after the drum is inserted. Clamp legs 11 extend along the opposite ends of the bottom cross plate 4 and also guide the plate for up-and-down movement toward and away from the bottom of the drum. An upright lock bolt 12 is threaded upward through the bottom cross plate 4 so that its upper end portion bears against the web of clamp 10 which is arcuate to approximate the curvature of the drum.

Each of two separate sling lines 13 and 14 has one end portion secured to the drum 6. The free end portions of the sling lines carry connecting plates 15 with eyes 16 allowing them to be conveniently secured to the load to be lifted such as to the opposite end portions of a vehicle engine to be removed or installed.

Figure 6:
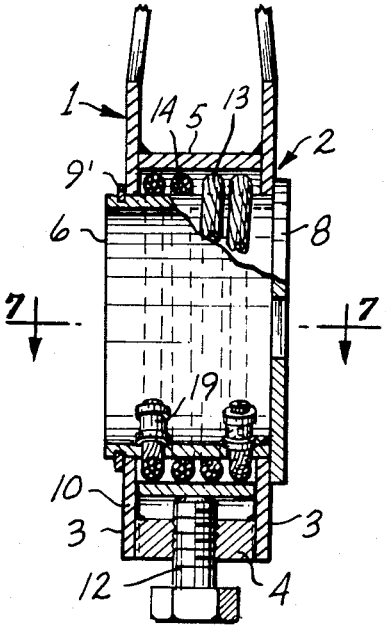
FIG. 6 is an enlarged fragmentary end elevation of the tilting hoist tackle of FIGS. 1, 2 and 3 with parts broken away.
Figure 7:
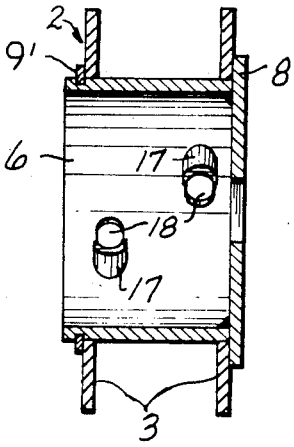
FIG. 7 is a horizontal section along line 7—7 of FIG. 6.

As best seen in FIG. 6, preferably the inner end portions of sling lines 13 and 14 are secured to the drum 6 adjacent to the opposite cheeks 3, respectively. Each line is wound on the drum at least one and one-half revolutions from an end portion of the drum toward the longitudinal center of the drum. For maximum strength and longevity of the lines, short narrow tabs 17 of the drum are punched inward to form narrow slots 18 through which the inner end portions of the lines can be threaded. The ends of the lines projecting inside of the drum are knobbed by crimped ferrules 19 of a diameter larger than the slots 18.

Figure 5:
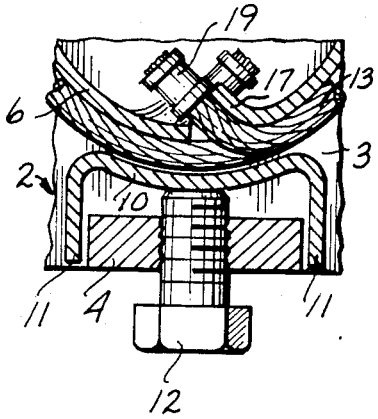
FIG. 5 is a further enlarged fragmentary, vertical transverse section thereof.

Preferably, each tab 17 is gradually curved inward with its inner end portion defining an acute angle of, preferably, about 45 degrees relative to a tangent of the drum in the area of the tab so that, as best seen in FIGS. 4 and 5, there is minimal bending of the inner end portion of the line. In addition, preferably each tab is concave in cross section to fit closely over the periphery of its line adjacent to the corresponding ferrule. Preferably, the outer side of each tab is approximately aligned with the inner side of the adjacent cheek leaving an unpunched structural joining section of the drum extending along the tab, and the tabs are spaced apart axially of the drum a distance at least equal to a multiple of the line diameter, and the tabs and their slots are spaced apart slightly circumferentially of the drum, so as not to affect the structural integrity of the drum. In the central position of the drum shown in the drawings where the free end portions of the lines 13 and 14 are of the same length, each line is wrapped around the drum precisely the same number of revolutions.

As best seen in FIG. 4, the top cross plate 5 is circular through an angle of more than 90 degrees, preferably about 120 degrees, and extends closely over the top of the drum from the locations of departure of the free end portions of the sling lines from the drum. Such plate acts as an arcuate guide and is spaced from the outer periphery of the drum a distance no greater than one and one-half times the line's diameter so that, with reference to FIG. 6, adjacent coils of line cannot cross or even ride up to a position where one coil is wedged between the plate and the adjacent coil. Returning to FIG. 4, preferably each of the open spaces between the ends of plate 5 and the ends of clamp 10 encompasses no more than about 45 degrees of the drum circumference which assures that the sling lines will not bind or cross even when the load is released.

With reference to FIGS. 2 and 3, the upper end portions of the cheeks 3 have registered apertures 20 forming an eye for convenient attachment to a conventional hoist such as by the hoist hook 21. The connecting plates 15 of the lines 13 and 14 are secured to the load to be lifted, such as at the opposite end portions of a vehicle engine. With the drum clamp 10 released by unscrewing the lock bolt 12, the drum can be turned to pay out one sling line and haul in the other and thereby tilt the load. For this purpose, the drum end plate 7 has a central square socket hole 22 for receiving the standard square projection of a conventional ratchet. With the load tilted to the desired degree, lock bolt 12 is turned to raise clamp 10 so as to bear against the coils of lines 13 and 14 and thereby prevent additional turning of the drum.

I claim:

1. Tilting hoist tackle for connection between a hoist and a load to be lifted, including a drum, a block adapted to be connected to the hoist and mounting the drum for rotation about a horizontal axis and locking means for deterring rotation of the drum but releasable to permit such rotation, characterized by the combination of two separate sling lines each having an inner end porition secured to the drum, said sling lines being wound on the drum in opposite senses and having free end portions adapted to be secured to the load at spaced locations so that, with the locking means released, rotation of the drum hauls in one sling line while paying out the other so as to tilt the load, the periphery of the drum having narrow slots and said inner end portions of said sling lines being threaded through said slots and having knobs inside the drum, said knobs being of a diameter greater than said slots for securing said sling lines inner end portions to the drum.

2. The tilting hoist tackle defined in claim 1, in which the slots are spaced apart circumferentially of the drum.

3. The tilting hoist tackle defined in claim 1, in which the slots are spaced inward from the opposite ends of the drum, respectively, leaving joining sections of the drum extending along the outer sides of the slots.

4. The tilting hoist tackle defined in claim 1, in which the drum has arcuate tabs punched inward in opposite senses, respectively, from the remainder of the outer periphery of the drum to form the slots.

5. The tilting hoist tackle defined in claim 4, in which each tab has an inner end portion defining an angle of no greater than about 45 degrees relative to a tangent in the area of such tab.

6. The tilting hoist tackle defined in claim 4, in which each tab is acruate in cross section to fit closely along the periphery of its sling line.

7. Tilting hoist tackle for connection between a hoist and a load to be lifted, including a drum, a block adapted to be connected to the hoist and mounting the drum for rotation abourt a horizontal axis and locking means for deterring rotation of the drum but releasably to permit such rotation, characterized by the combination of two separate sling lines each having an inner end portion secured to the drum, said slign lines being wound on the drum in opposite senses and having free end portions adapted to be secured to the load at spaced locations so that, with the locking means released, rotation of the drum hauls in one sling line while paying out the other so as to tilt the load, the block including opposite upright cheeks having registered apertures in which the drum is journaled, an arcuate guide plate extending between said cheeks, coaxial with the drum, and closely encircling the drum, said guide plate extending over the top of the drum, and an elongated arcuate bottom member extending along the bottom of the drum leaving open areas between the opposite ends of said arcuate bottom member and the opposite ends of said guide plate, each of said open areas encompassing no more than about 45 degrees of the circumference of the drum.

8. Tilting hoist tackle for connection between a hoist and a load to be lifted, including a drum, a block adapted to be connected to the hoist and mounting the drum for rotation about a horizontal axis and locking means for deterring rotation of the drum but releasable to permit such rotation, characterized by the combination of two separate sling lines each having an inner end portion secured to the drum, said sling lines being wound on the drum in opposite senses and having free end portions adapted to be secured to the load at spaced locations so that, with the locking means released, rotation of the drum hauls in one sling line while paying out the other so as to tilt the load, the periphery of the drum having narrow slots and said inner end portions of said sling lines being threaded through said slots, and means for securing said sling line inner end portions inside the drum.

* * * * *

UNITED STATES PATENT AND TRADEMARK OFFICE

CERTIFICATE OF CORRECTION

PATENT NO. : 4,684,162

DATED : August 4, 1987

INVENTOR(S) : Butler, David L.

It is certified that error appears in the above-identified patent and that said Letters Patent are hereby corrected as shown below:

Claim 1: column 3, line 44, cancel "porition" and insert ...portion...

Claim 6: column 4, line 14, cancel "acruate" and insert ...arcuate...

Claim 7: column 4, line 19, cancel "abourt" and insert ...about...; line 20, cancel "releasably" and insert ...releasable...; line 23, cancel "slign" and insert ...sling...

Signed and Sealed this

Twenty-fourth Day of November, 1987

*Attest:*

DONALD J. QUIGG

*Attesting Officer*

*Commissioner of Patents and Trademarks*